US009131594B2

(12) United States Patent
Heid

(10) Patent No.: US 9,131,594 B2
(45) Date of Patent: Sep. 8, 2015

(54) RF RESONATOR CAVITY AND ACCELERATOR

(75) Inventor: Oliver Heid, Erlangen (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 13/581,101

(22) PCT Filed: Feb. 2, 2011

(86) PCT No.: PCT/EP2011/051464

§ 371 (c)(1), (2), (4) Date: Aug. 24, 2012

(87) PCT Pub. No.: WO2011/104079

PCT Pub. Date: Sep. 1, 2011

(65) Prior Publication Data

US 2012/0319580 A1 Dec. 20, 2012

(30) Foreign Application Priority Data

Feb. 24, 2010 (DE) ..... 10 2010 009 024

(51) Int. Cl.
*H01J 23/20* (2006.01)
*H05H 7/22* (2006.01)
*H05H 7/18* (2006.01)

(52) U.S. Cl.
CPC .. *H05H 7/22* (2013.01); *H05H 7/18* (2013.01)

(58) Field of Classification Search
USPC ..... 315/5.51, 500–505
See application file for complete search history.

(56) References Cited

U.S. PATENT DOCUMENTS 2,563,585 A 8/1951 Dällenbach ..... 315/4
3,683,235 A 8/1972 Graham et al. ..... 315/5.34

(Continued)

FOREIGN PATENT DOCUMENTS

CN 101002510 A 7/2007 ..... H05H 13/00
DE 2036383 A1 2/1971 ..... H01J 23/083

(Continued)

OTHER PUBLICATIONS

Kilpatrick, W.D., "Criterion for Vacuum Sparking Designed to Include Both rf and dc," The Review of Scientific Instruments, vol. 28, No. 10, 3 pages, Oct. 1957.

(Continued)

*Primary Examiner* — Douglas W Owens
*Assistant Examiner* — Srinivas Sathiraju
(74) *Attorney, Agent, or Firm* — Slayden Grubert Beard PLLC

(57) ABSTRACT

An RF resonator cavity for accelerating charged particles is provided, wherein an electromagnetic RF field can be coupled into the RF resonator cavity. During operation, the RF field acts on a particle beam which traverses the RF resonator cavity. At least one intermediate electrode for increasing the dielectric strength is arranged in the RF resonator cavity along the beam path of the particle beam, wherein the conductivity of the intermediate electrode is limited such that upon coupling-in of the electromagnetic RF field at the operating frequency of the RF resonator cavity the intermediate electrode is at least partially penetrated by the coupled-in electromagnetic RF field.

13 Claims, 2 Drawing Sheets

(56) References Cited

U.S. PATENT DOCUMENTS

| | | | | |
|---|---|---|---|---|
| 3,764,838 | A | 10/1973 | Charpentier | 313/360.1 |
| 4,737,426 | A | 4/1988 | Roth | 430/17 |
| 5,014,014 | A * | 5/1991 | Swenson | 315/505 |
| 5,532,210 | A * | 7/1996 | Shen | 505/200 |
| 5,587,207 | A * | 12/1996 | Gorokhovsky | 427/571 |
| 5,648,980 | A * | 7/1997 | Seguin | 372/92 |
| 5,689,523 | A * | 11/1997 | Seguin | 372/82 |
| 5,849,252 | A * | 12/1998 | Wakamoto et al. | 422/186.04 |
| 6,025,681 | A | 2/2000 | Yu et al. | 315/500 |
| 6,423,976 | B1 * | 7/2002 | Glavish et al. | 250/492.21 |
| 6,653,642 | B2 * | 11/2003 | Pedersen et al. | 250/492.21 |
| 7,112,924 | B2 * | 9/2006 | Hanna | 315/5.41 |
| 7,880,408 | B2 | 2/2011 | Calabretta et al. | 315/502 |
| 8,067,907 | B2 * | 11/2011 | Morita et al. | 315/500 |
| 8,148,923 | B2 * | 4/2012 | Alimov et al. | 315/505 |
| 8,558,486 | B2 * | 10/2013 | Smick et al. | 315/505 |
| 2005/0189881 | A1 * | 9/2005 | Sobieradzki et al. | 315/5.38 |
| 2009/0206967 | A1 * | 8/2009 | Antaya | 335/216 |
| 2012/0194104 | A1 * | 8/2012 | Heid | 315/501 |
| 2012/0235603 | A1 * | 9/2012 | Heid | 315/505 |
| 2012/0319580 | A1 * | 12/2012 | Heid | 315/5.51 |

FOREIGN PATENT DOCUMENTS

| | | | | |
|---|---|---|---|---|
| DE | 3919210 | A1 | 12/1990 | H05H 7/02 |
| EP | 0209398 | A2 | 1/1987 | H05H 7/06 |
| EP | 0514585 | A2 | 11/1992 | H05H 7/18 |
| EP | 0660363 | A1 | 6/1995 | H01J 23/16 |
| GB | 685654 | A | 1/1953 | H01P 3/12 |
| GB | 752598 | A | 7/1956 | H01J 23/207 |
| GB | 835711 | A | 5/1960 | H05H 9/04 |
| WO | 98/33228 | A2 | 7/1998 | H05H 7/22 |

OTHER PUBLICATIONS

Lesch, Dr.-Ing. Guntram, *Lehrbuch der Hochspannungstechnik*, book, Springer-Verlag, Berlin/Göttinger/Heidelberg, p. 155 (2 pages total) (German w/ English translation), 1959.

Dôme, G., "Review and Survey of Accelerating Structures," book, North Holland Publishing Co., Amsterdam, pp. 637 & 711 (2 pages total), Jan. 1, 1969.

International Search Report and Written Opinion, Application No. PCT/EP2011/051464, 16 pages, May 6, 2011.

Chinese Office Action, Application No. 2011800106405, 17 pages, May 14, 2014.

* cited by examiner

RF RESONATOR CAVITY AND ACCELERATOR

CROSS-REFERENCE TO RELATED APPLICATIONS

This application is a U.S. National Stage Application of International Application No. PCT/EP2011/051464 filed Feb. 2, 2011, which designates the United States of America, and claims priority to DE Patent Application No. 10 2010 009 024.7 filed Feb. 24, 2010. The contents of which are hereby incorporated by reference in their entirety.

TECHNICAL FIELD

This disclosure relates to an RF resonator cavity, with which charged particles in the form of a particle beam can be accelerated when they are guided through the RF resonator cavity and when an RF field acts on the particle beam in the RF resonator cavity, and to an accelerator having such an RF resonator cavity.

BACKGROUND

RF resonator cavities are known in the industry. The acceleration generated by an RF resonator cavity depends on the strength of the electromagnetic RF field generated in the RF resonator cavity, which electromagnetic RF field acts on the particle beam along the particle path. Since with increasing field strengths of the RF field the likelihood increases that sparking occurs between the electrodes, the maximum particle energy achievable is limited by the RF resonator cavity.

The electrical breakdown problem in particle accelerators was examined by W. D. Kilpatrick in the article "Criterion for Vacuum Sparking Designed to Include Both rf and dc", Rev. Sci. Instrum. 28, 824-826 (1957). In a first approximation, the maximum achievable field strength E of the electrical RF field has the following relationship with the frequency f of the RF field: $E \sim \sqrt{f}$. This means that higher electrical field strengths can be achieved if a higher frequency is used before electrical breakdown (also referred to as "RF breakdown") occurs.

SUMMARY

In one embodiment, an RF resonator cavity for accelerating charged particles is provided, wherein an electromagnetic RF field can be coupled into the RF resonator cavity, which electromagnetic RF field during operation acts on a particle beam which passes through the RF resonator cavity, wherein at least one intermediate electrode for increasing the electrical breakdown strength is arranged in the RF resonator cavity along the beam path of the particle beam, wherein the intermediate electrode has a limited conductivity such that, upon coupling-in of the electromagnetic RF field at operating frequency of the RF resonator cavity, the intermediate electrode is at least partially permeated by the coupled-in electromagnetic RF field.

In a further embodiment, the intermediate electrode comprises a thin layer with limited conductivity, such that the coupled-in electromagnetic RF field permeates the intermediate electrode at the operating frequency of the RF resonator cavity. In a further embodiment, the intermediate electrode comprises a carrier insulator coated with a metal surface. In a further embodiment, the intermediate electrode is insulated from a wall of the RF resonator cavity such that the intermediate electrode during operation of the RF resonator cavity does not produce an RF field which acts in an accelerating manner on the particle beam. In a further embodiment, the intermediate electrode is coupled via a conductive connection to the wall of the RF resonator cavity, such that the conductive connection has a high impedance at the operating frequency of the RF resonator cavity, as a result of which the intermediate electrode is insulated with respect to the wall of the RF resonator cavity such that the intermediate electrode during operation of the RF resonator cavity does not produce an RF field which acts in an accelerating manner on the particle beam. In a further embodiment, the conductive connection comprises a helically guided conductor portion. In a further embodiment, the intermediate electrode is moveably mounted, in particular using a resilient bearing. In a further embodiment, the material of the intermediate electrode comprises chromium, vanadium, titanium, molybdenum, tantalum and/or tungsten. In a further embodiment, the intermediate electrode has the shape of a ring disk. In a further embodiment, a plurality of intermediate electrodes are arranged one after the other in the beam direction. In a further embodiment, In another embodiment, an accelerator for accelerating charged particles includes an RF resonator cavity having any of the features disclosed above.

BRIEF DESCRIPTION OF THE DRAWINGS

Example embodiments will be explained in more detail below with reference to figures, in which.

DETAILED DESCRIPTION

Figure 1:
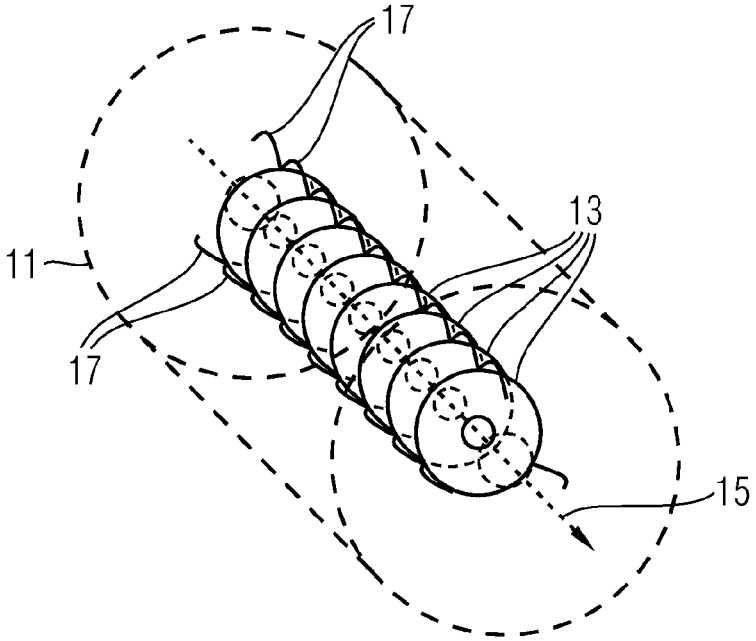
FIG. 1 shows schematically the construction of an RF resonator cavity with inserted intermediate electrodes.

Some embodiments provide an RF resonator cavity with a high breakdown strength.

For example, an RF resonator cavity for accelerating charged particles may be provided, into which an electromagnetic RF field can be coupled which during operation acts on a particle beam which passes through the RF resonator cavity, wherein at least one intermediate electrode for increasing the electrical breakdown strength is arranged in the RF resonator cavity along the beam path of the particle beam.

The intermediate electrode is in this case configured or has a limited conductivity such that, upon coupling-in of the electromagnetic RF field at operating frequency of the RF resonator cavity, the intermediate electrode is at least partially permeated by the coupled-in electromagnetic RF field.

It has been found that an application of the criterion according to Kilpatrick has triggered a trend in accelerators toward high frequencies. However, this is a problem especially for the acceleration of slow particles, that is to say of particles with non-relativistic velocities, from ion-optical reasons. In large accelerators this means that in the first accelerator stages, low frequency and a corresponding low E-field strength are used during operation, and that typically only the later, subsequent accelerator stages may be operated at the more advantageous higher frequency. Owing to the synchronicity, the frequencies have a rational ratio with respect to one another. This, however, leads to large accelerators requiring space and also to less flexibility in the choice of accelerator design.

However, certain embodiments are based on the realization that it is not necessarily the frequency (according to the Kilpatrick criterion) that influences as an essential factor the maximum achievable E-field strength in a vacuum but also the electrode distance d, in a first approximation defined by the relationship $E \sim 1/\sqrt{d}$ (for the dielectric strength U in a first approximation $U \sim \sqrt{d}$). In the book "Lehrbuch der Hochspannungstechnik," G. Lesch, E. Baumann, Springer-Verlag, Berlin/Göttingen/Heidelberg, 1959, page 155 shows a diagram for illustrating the relationship between breakdown field strength in a high vacuum and plate distance. This relationship obviously applies universally over a very large voltage range, in the same manner for DC and AC voltage and for geometrically scaled electrode forms. The choice of the electrode material obviously influences only the proportionality constant.

The experimental Kilpatrick criterion $E \sim \sqrt{f}$ contains no parameter which explicitly takes into account the electrode distance. This apparent contradiction to the relationship above which includes the electrode distance is resolved, however, if it is assumed that the form of the resonator remains geometrically similar during scaling for matching the frequency, such that the electrode distance is scaled together with the other dimensions of the resonator. This means a choice of the electrode distance d according to $d \sim 1/f$ and thus a correspondence between the Kilpatrick criterion $E \sim \sqrt{f}$ with the criterion $E \sim 1\sqrt{d}$ established above.

As a consequence of this consideration, it is found that high frequencies only appear to be helpful. The frequency dependence according to the Kilpatrick criterion can be at least partially simulated by the geometric scaling for resonance tuning. However, it is possible for the frequency in the larger context to be selected independently of the desired maximum E-field strength of the RF field, such that compact accelerators in principle become possible even at low frequencies, for example for heavy ions. This is achieved by way of the RF resonator cavity according to certain embodiments since here the breakdown strength is countered with the intermediate electrodes. Eventually this leads to a high electrical breakdown strength and associated high E-field strengths by observing the criterion $E \sim 1/\sqrt{d}$. The operating frequency of the RF resonator can be selected in a clearly more flexible manner and ideally independently of the desired E-field strength, and the electrical breakdown strength to be achieved is made possible by the intermediate electrodes and not the choice of the operating frequency.

Aspects or embodiments disclosed herein are based here on the consideration of using smaller electrode distances in order to achieve higher E field strengths. However, since the electrode distances are initially defined by the resonator form, a smaller electrode distance is resolved here by introducing the intermediate electrode(s). The distance between the electrodes is consequently divided into smaller sections by the intermediate electrode(s). The distance requirement with regard to breakdown strength can thus be fulfilled largely independently of the resonator size and resonator shape.

In addition, certain embodiments are based on the finding that there are advantages if such intermediate electrodes have a limited conductivity, such that at the operating frequency of the RF resonator cavity, they are at least partially permeated by the electromagnetic fields prevailing in the RF resonator cavity. The intermediate electrodes then have no field-free interior.

The losses which occur in an intermediate electrode of this type, on account of the eddy currents induced in the intermediate electrode, are significantly reduced with respect to intermediate electrodes whose interior is field-free.

In one embodiment, the intermediate electrode can comprise a thin layer with limited conductivity, such that the coupled-in electromagnetic RF field permeates the intermediate electrode at the operating frequency of the RF resonator cavity. The intermediate electrode can, for example, comprise a thin metal disk which has this property.

In one embodiment, the intermediate electrode can comprise a carrier insulator coated with a metal surface. This construction also enables the intermediate electrode to be permeated at least partially by the electromagnetic field acting on the particle beam in the resonator cavity.

The intermediate electrodes thus fulfill the purpose of increasing the electrical breakdown strength. In order to influence the RF resonator cavity as little as possible in terms of its accelerating properties, the intermediate electrode can be insulated from the walls of the RF resonator cavity such that the intermediate electrode during operation of the RF resonator cavity does not produce an RF field which acts in an accelerating manner on the particle beam. Owing to the insulation, no RF power is transferred from the walls to the intermediate electrodes, which would otherwise generate, starting from the intermediate electrodes, an RF field acting on the particle beam.

During operation, no RF field is transferred from the resonator walls to the intermediate electrode, or only to such a small extent that the RF field which is emitted by the intermediate electrode—if at all—is negligible and, in the best case, does not contribute to, or influence, the acceleration of the particle beam at all. In particular, no RF currents flow from the resonator walls to the intermediate electrodes.

The insulation with respect to the resonator walls does not necessarily need to be complete, it suffices to configure the coupling of the intermediate electrode to the resonator walls such that the intermediate electrode in the frequency range of the operating frequency of the RF cavity is largely insulated. For example, the intermediate electrode can be coupled via a conductive connection to a wall of the RF resonator cavity, such that the conductive connection has a high impedance at the operating frequency of the RF resonator cavity, as a result of which the desired insulation with respect to the intermediate electrode can be achieved. The intermediate electrode is consequently largely decoupled in terms of RF energy from the RF resonator cavity. Thus, the RF resonator cavity is damped by the intermediate electrodes only to a small extent. The conductive connection can nevertheless at the same time assume the function of charge dissipation by scattering particles. The high impedance of the conductive connection can be realized via a helically guided conductor portion. Such a bearing can also have a resilient configuration.

The intermediate electrodes are arranged in particular perpendicular to the electric RF field acting on the particle beam. Thus, as low an influence as possible on the functionality of the RF cavity by the intermediate electrodes is achieved.

The intermediate electrode can, for example, have the shape of a ring disk, having a central hole, through which the particle beam is guided. The form of the intermediate electrodes can be matched to the E-field potential surfaces which occur without intermediate electrodes, such that no significant distortion of the ideal, intermediate-electrode-free E-field distribution occurs. With such a form, the capacitance increase owing to the additional structures is minimized, a detuning of the resonator and local E-field enhancement are largely avoided.

The intermediate electrode may be moveably mounted, for example by way of a resilient bearing or suspension. The resilient bearing can be configured in the shape of a hairpin. The creeping discharge path along the surface is thus optimized or maximized, the likelihood of creeping discharges occurring is minimized. The resilient bearing can comprise a helical conductive portion, as a result of which an impedance increase of the resilient bearing at the operating frequency of the RF resonator cavity can be achieved.

The material of the intermediate electrode used can be chromium, vanadium, titanium, molybdenum, tantalum, tungsten or an alloy comprising these materials. These materials have a high E-field strength. The lower surface conductivity in these materials may be advantageous because it is possible in this manner to easily ensure that during operation they are permeated at least partially by the electromagnetic RF fields coupled into the RF resonator cavity.

A plurality of intermediate electrodes may be arranged in the RF resonator cavity one after the other in the beam direction. The plurality of intermediate electrodes can be moveably mounted, for example with respect to one another via a resilient suspension. The individual distances of the electrodes can thus automatically uniformly distribute themselves.

The resilient bearings with which the plurality of intermediate electrodes are connected to one another can be configured to be conductive and may comprise a helical conductive portion and/or be configured in the shape of a hairpin. This also permits charge dissipation by scattering particles between the intermediate electrodes.

The accelerator disclosed herein may include at least one of the above-described RF resonator cavities with an intermediate electrode.

FIG. 1 shows the RF resonator cavity 11. The RF resonator cavity 11 itself is illustrated in dashed lines, in order to be able to more clearly illustrate the intermediate electrodes 13 which are located inside the RF resonator cavity 11.

The RF resonator cavity 11 typically comprises conductive walls and is supplied with RF energy by an RF transmitter (not illustrated here). The accelerating RF field acting on the particle beam 15 in the RF resonator cavity 11 is typically produced by an RF transmitter arranged outside the RF resonator cavity 11 and is introduced into the RF resonator cavity 11 in a resonant manner. The RF resonator cavity 11 typically contains a high vacuum.

The intermediate electrodes 13 are arranged in the RF resonator cavity 11 along the beam path. The intermediate electrodes 13 are configured in the form of a ring with a central hole, through which the particle beam passes. A vacuum is located between the intermediate electrodes 13.

The intermediate electrodes 13 are mounted with a resilient suspension 17 with respect to the RF resonator cavity 11 and with respect to one another.

Owing to the resilient suspension 17, the intermediate electrodes 13 distribute themselves automatically over the length of the RF resonator cavity 11. Additional suspensions, which serve for stabilizing the intermediate electrodes 13 (not illustrated here), can likewise be provided.

Figure 2:
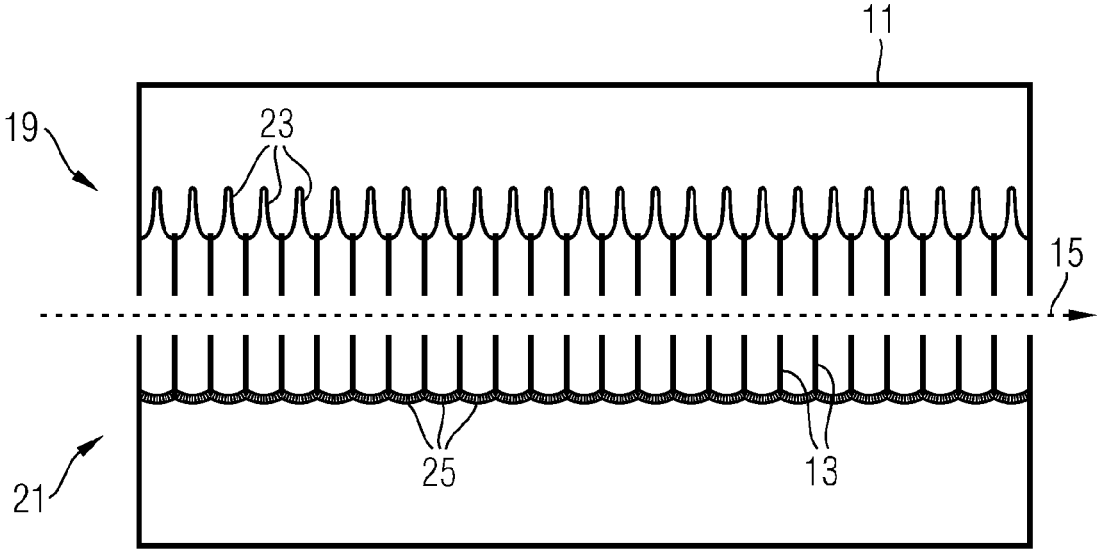
FIG. 2 shows a longitudinal section through such an RF resonator cavity.

FIG. 2 shows a longitudinal section through the RF resonator cavity 11 shown in FIG. 1, wherein here different types of suspension of the intermediate electrodes 13 with respect to one another and with respect to the resonator walls are shown.

The top half 19 of FIG. 2 shows a resilient suspension of the intermediate electrodes 13 with hairpin-shaped, conductive connections 23. Owing to the hairpin shape, the likelihood of a creeping discharge along the suspension decreases.

In the bottom half 21 of the RF resonator cavity shown in FIG. 2, the intermediate electrodes 13 are connected via helically guided, conductive resilient connections 25 with respect to one another and with respect to the resonator walls. With this configuration, the helical guidance of the conductive connection 25 may constitute an impedance which, in the case of a corresponding configuration, produces the desired insulation of the intermediate electrodes with respect to the resonator walls at the operating frequency of the RF resonator cavity 11. In this manner, too much damping of the RF resonator cavity 11 owing to the insertion of the intermediate electrodes 13 into the RF resonator cavity 11 is avoided.

Figure 3:
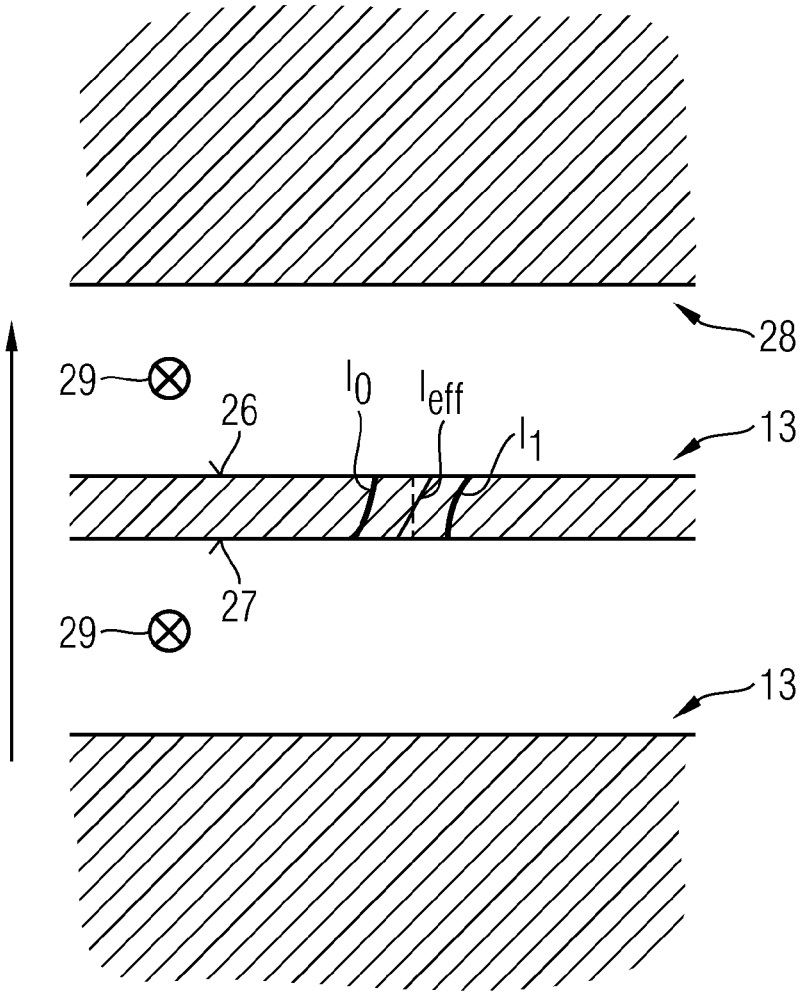
FIG. 3 shows the illustration of a detail of an intermediate electrode of thin construction and with current densities induced in the intermediate electrode.

FIG. 3 shows the two surfaces 26, 27 in a detail from an intermediate electrode 13. The beam course direction is perpendicular to the two surfaces (arrow). Indicated here are also details of the wall 28 of the RF resonator cavity 11. Distances and dimensions are not shown to scale in FIG. 3, which is used for illustrating the principle.

The current density which is generated in the intermediate electrode 13 by the electromagnetic fields 29, which are coupled into the RF resonator cavity during operation, are composed of two components $I_0$ and $I_1$. Owing to the fact that the intermediate electrode 13 has a limited electrical conductivity, the current density $I_1$, which is generated by the electromagnetic fields 29 on the upper surface 26 of the intermediate electrode 13, does not decay completely over the thickness of the intermediate electrode 13. The same is true for the current density $I_0$, which is generated by the electromagnetic fields 29 on the lower surface 27 of the intermediate electrode 13. Owing to the fact that the two current densities $I_0$ and $I_1$ do not completely decay over the thickness and are opposite to one another, the two current densities $I_0$ and $I_1$ largely cancel each other ($I_{eff}=I_0+I_1$).

Overall, eddy currents are thus produced to a lower extent inside the intermediate electrode 13 as compared to intermediate electrodes whose conductivity is such that, during operation of the RF resonator cavity, a field-free interior is present in the intermediate electrode.

Figure 4:
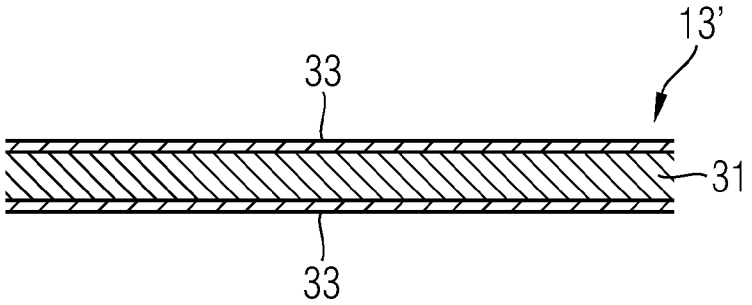
FIG. 4 shows the illustration of a detail of an intermediate electrode that shows a carrier insulator with a metal layer applied thereon.

FIG. 4 shows the construction of an intermediate electrode 13' with a carrier insulator 31, on which metal layers 33 are applied. With such a construction it is also possible to achieve the goal of the coupled-in RF fields at least partially permeating the intermediate electrode 13'.

LIST OF REFERENCE SIGNS

11 RF resonator cavity
13, 13' intermediate electrode
15 particle beam
17 suspension
19 upper part
21 lower part
23 hairpin-shaped connection
25 helical connection
26 upper surface
27 lower surface
28 wall
29 RF field
31 carrier insulator
33 metal layer

What is claimed is:

1. An RF resonator cavity for accelerating charged particles, wherein the RF resonator cavity is configured for coupling to an electromagnetic RF field that, during operation, acts on a particle beam which passes through the RF resonator cavity, comprising a plurality of intermediate electrodes arranged in the RF resonator cavity along the beam path of the particle beam and configured to increase the electrical breakdown strength, wherein the plurality of intermediate electrodes are suspended within the RF resonator cavity such that the intermediate electrodes spaced apart from an interior wall of the RF resonator cavity in a radially inward direction, wherein the plurality of intermediate electrodes are moveably mounted with a resilient bearing, and wherein each intermediate electrode has a limited conductivity such that, upon coupling-in of the electromagnetic RF field at operating frequency of the RF resonator cavity, the intermediate electrode is at least partially permeated by the coupled-in electromagnetic RF field.

2. The RF resonator cavity of claim 1, wherein the intermediate electrode comprises a thin layer with limited conductivity, such that the coupled-in electromagnetic RF field permeates the intermediate electrode at the operating frequency of the RF resonator cavity.

3. The RF resonator cavity of claim 1, wherein the intermediate electrode comprises a carrier insulator coated with a metal surface.

4. The RF resonator cavity of claim 1, wherein the intermediate electrode is insulated from a wall of the RF resonator cavity such that the intermediate electrode during operation of the RF resonator cavity does not produce an RF field which acts in an accelerating manner on the particle beam.

5. The RF resonator cavity of claim 4, wherein the intermediate electrode is coupled via a conductive connection to the wall of the RF resonator cavity, such that the conductive connection has a high impedance at the operating frequency of the RF resonator cavity, as a result of which the intermediate electrode is insulated with respect to the wall of the RF resonator cavity such that the intermediate electrode during operation of the RF resonator cavity does not produce an RF field which acts in an accelerating manner on the particle beam.

6. The RF resonator cavity of claim 5, wherein the conductive connection comprises a helically guided conductor portion extending helically along the direction of the particle beam path.

7. The RF resonator cavity of claim 1, wherein the material of the intermediate electrode comprises at least one of chromium, vanadium, titanium molybdenum, tantalum, and tungsten.

8. The RF resonator cavity of claim 1, wherein the intermediate electrode has the shape of a ring disk.

9. The RF resonator cavity of claim 1, wherein a plurality of intermediate electrodes are arranged one after the other in the beam direction.

10. The RF resonator cavity of claim 1, wherein the plurality of intermediate electrodes are suspended within the RF resonator cavity by a resilient bearing or suspension structure that maintains the intermediate electrodes spaced apart from the interior wall of the RF resonator cavity in the radially inward direction.

11. The RF resonator cavity of claim 10, wherein the plurality of intermediate electrodes are moveably suspended within the RF resonator cavity by the resilient bearing or suspension structure.

12. The RF resonator cavity of claim 10, wherein the resilient bearing or suspension structure is configured to automatically provide uniform spacing between the plurality of intermediate electrodes.

13. The RF resonator cavity of claim 1, wherein the plurality of intermediate electrodes are suspended within the RF resonator cavity by a common mounting structure shared by the plurality of intermediate electrodes.

* * * * *